United States Patent [19]

Tompkins, Jr. et al.

[11] Patent Number: 4,594,988

[45] Date of Patent: Jun. 17, 1986

[54] METHOD FOR BUILDING OR REPAIRING ROTARY INJECTION FUEL PUMP PISTON CYLINDERS

[76] Inventors: Martin J. Tompkins, Jr., 2430 Veltema, Holt, Mich. 48842; Eugene G. Ash, 1406 121st Ave., Rte. 2, Hopkins, Mich. 49328

[21] Appl. No.: 723,267

[22] Filed: Apr. 15, 1985

[51] Int. Cl.[4] ..... F02M 59/20

[52] U.S. Cl. ..... 123/502

[58] Field of Search ..... 123/502, 501; 417/462

[56] References Cited

U.S. PATENT DOCUMENTS

| | | | |
|---|---|---|---|
| 4,041,919 | 8/1977 | Bonin | 123/502 |
| 4,079,719 | 3/1978 | Varcoe et al. | 123/502 |
| 4,224,916 | 9/1980 | Davis | 123/502 |
| 4,432,327 | 2/1984 | Salzeber | 123/502 |
| 4,453,522 | 10/1977 | Salzeber | 123/502 |

FOREIGN PATENT DOCUMENTS

| | | | |
|---|---|---|---|
| 3332636 | 4/1984 | Fed. Rep. of Germany | 123/502 |

*Primary Examiner*—Magdalen Y. C. Moy

*Attorney, Agent, or Firm*—Ian C. McLeod

[57] ABSTRACT

A method for providing an improved sleeve 100 as a cylinder 62 for an advance piston 50 of a rotary fuel injection pump is described. The sleeve 100 provides long cylinder 62 life with a piston 50 made of a much harder material such as steel. The method is particularly suited for repairing such fuel pumps, but can also be used for newly manufactured pumps.

8 Claims, 5 Drawing Figures

METHOD FOR BUILDING OR REPAIRING ROTARY INJECTION FUEL PUMP PISTON CYLINDERS

BACKGROUND OF THE INVENTION (1) Field of the Invention

The present invention relates to a method for building or repairing rotary fuel injection pump timing piston cylinders. In particular the present invention relates to a unique sleeving method.

(2) Prior Art

Regulating the timing of fuel injection in rotary pumps has been directed to changing the position of a timing control piston under various engine operating conditions. U.S. Pat. No. 4,224,916 to Charles W. Davis discloses a timing control for a rotary fuel injection pump wherein the position of a timing piston is adjusted in response to the increase in engine speed. U.S. Pat. No. 4,432,327 describes an improved timing control for a fuel injection pump using a drainage passage and valve for outlet from a cylinder housing a timing piston. U.S. Pat. No. 4,453,522 to Daniel E. Salzgeber discloses a means for effecting the position of a timing piston and consequently the advance of the fuel injection to compensate for conditions when the engine is cold.

U.S. Pat. No. 4,432,327 describes the operation of rotary fuel injection pumps in a particularly effective manner and this disclosure is incorporated herein. Obtaining precise timing of the fuel injection into an engine cylinder in relation to the top dead center (TDC) position of the piston is a critical factor in minimizing the discharge into the environment of pollutants from the exhaust of the internal combustion engine, as well as minimizing the engine noise level. More precise regulation of the timing of the fuel injection is necessitated by increasing environmental considerations and regulatory mandates. Improved injection timing regulation results from both a more precise means for advancing and retarding the timing of fuel injection and also sensing means for taking into account more operating parameters of the engine when determining the optimum degree of timing advancement of retarding to be applied.

The injection of fuel in compression-ignition or diesel engines normally occurs at a time when the piston is in the vicinity of its TDC. The desired time of fuel injection varies for different engine designs and ranges from a time slightly prior to TDC to a time slightly after TDC. In the normal course of operating an engine, various operating parameters such as speed, load, engine temperature, and altitude may vary over ranges which require timing adjustments which are substantial enough to have a significant impact on obtaining optimum timing of fuel injection.

A number of general considerations have been established. As the engine speed in r.p.m. increases, the timing of fuel injection should normally occur earlier relative to TDC. The time interval for fuel to flow from injection pump to injection nozzle is not a function of engine speed although the time required for combustion in the engine is a function of engine speed. Therefore, a mechanism is frequently employed to adjust the timing of fuel injection to compensate for wide ranges in engine speed. A second important factor requiring timing adjustment may result from engine load differences or changes in r.p.m. For example, advancing the timing of fuel injection for fast acceleration is generally advantageous. A third timing adjustment may be required to compensate for engine temperature. It is generally advantageous to advance the timing of fuel injection in a cold engine operating at relatively low speed. A fourth factor for which an adjustment in injection timing is desirable is the altitude at which the engine is operating. In general, at higher altitudes the timing of fuel injection should be advanced. Other factors, such as pump wear and fuel density, may also require an adjustment of the setting of the timing mechanism to obtain the desired timing of injection.

In rotary fuel injection pumps, wherein position changes of a cam contour or lobe around the axis of rotation is translated into pumping strokes of plungers around a rotor actuated by the cam lobes, the fuel injection timing is provided by a timing control acting on the cam to advance or retard the timing of the injection pumping stroke, and to consequently provide for a control of the timing of the injection of fuel into the engine cylinder. A timing control piston is provided which mechanically interacts with the cam to advance or retard the timing corresponding to the relative position of the piston in a hydraulically (fuel) controlled cylinder. This control piston is thus very active in the operation of the engine and rapidly causes wear of the cylinder in which it is housed.

The rapid wear of the timing piston cylinder is because of two factors: (1) inexpensive epoxy impregnated aluminum housing castings; and (2) pistons which are made of materials which are much harder than the wall of the cylinder. This problem causes leakage around the control piston thus interfering with proper operation. Further, an expensive fuel pump can fail in as little as a few hundred to a few thousand miles of vehicle use depending upon the composition of the wall of the cylinder. This problem has caused large losses in warranty repairs and has defied a reliable and inexpensive solution.

Various methods have been tried to build or repair the wall of the cylinder for the control piston. This includes brass sleeves to refurbish the cylinder, cylinder wall and/or plating of the wall with nickel. These repairs have met with limited success and are not durable.

OBJECTS

It is therefore an object of the present invention to provide an improved method of sleeving to provide the walls of the cylinder for the control piston. Further it is an object of the present invention to provide a unique improved sleeve. Further still it is an object of the present invention to provide a method of repairing or building rotary fuel injection pumps which is simple, economical and which provides tens of thousands of miles of reliable vehicle use. These and other objects will become increasingly apparent by reference to the following description and the drawings.

IN THE DRAWINGS

GENERAL DESCRIPTION

Figure 1:
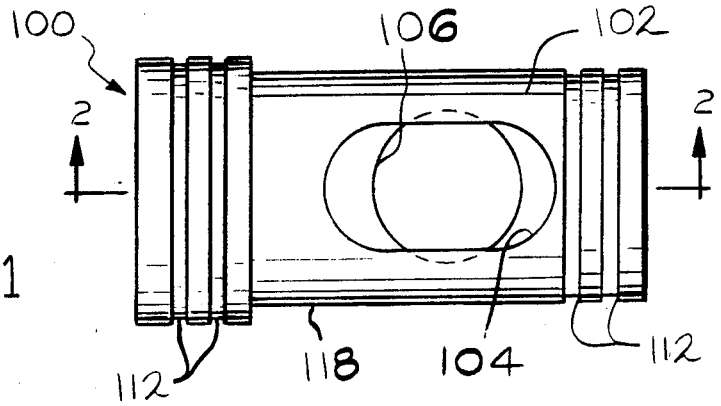
FIG. 1 is a front cross-sectional view of the sleeve (100) of the present invention.

The present invention relates to an improvement in a rotary fuel injection pump for an internal combustion engine including a housing with inlet and outlet passages, a rotor having a longitudinal axis journaled in the housing having a rotor body with a plurality of angularly spaced radially extending bores and a fuel passage in communication with the inner ends of the bores having inlet and outlet ports which communicate alternately with said inlet and outlet passages during rotation of the rotor for alternately conducting fuel to and from the bores respectively, a plunger assembly for each bore comprising a pump plunger reciprocally mounted in the bore to sequentially receive charges of fuel from and deliver them to said inlet and outlet passages respectively, and a plunger operating roller and roller shoe at the outer end of the plunger having a radial position relative to the axis of the rotor, a cam ring with an inner cam contour surrounding the rotor in the plane of revolution of the rollers and engageable therewith to translate the cam contour into reciprocal movement of the plungers, and a plunger stroke limit mechanism for limiting the outward stroke of the plungers and thereby regulate the quantity of fuel injected during each inward pumping stroke thereof, a timing advance connector connected to the cam ring for changing the radial position of the lobes in the plane of revolution of the rollers relative to the rollers to thereby advance or retard the fuel injection depending upon the position of the cam ring, a timing means controlling the movement of a hydraulic timing piston mounted in a cylinder which moves the connector, the improvement which comprises, an aluminum sleeve with an inside wall providing the cylinder for the timing piston mounted in the housing, wherein the sleeve has a hard anodized coating on the wall adjacent the timing piston and wherein an outside wall of the sleeve is secured to the housing.

Further the present invention relates to a method of manufacturing a rotary fuel injection pump including a rotary fuel injection pump for an internal combustion engine having a housing with inlet and outlet passages, a rotor having a longitudinal axis journaled in the housing having a rotor body with a plurality of angularly spaced radially extending bores and a fuel passage in communication with the inner ends of the bores having inlet and outlet ports which communicate alternately with said inlet and outlet passages during rotation of the rotor for alternately conducting fuel to and from the bores respectively, a plunger assembly for each bore comprising a pump plunger reciprocally mounted in the bore to sequentially receive charges of fuel from and deliver them to said inlet and outlet passages respectively, and a plunger operating roller and roller shoe at the outer end of the plunger having a radial position relative to the axis of the rotor, a cam ring with an inner cam contour surrounding the rotor in the plane of revolution of the rollers and engageable therewith to translate the cam contour into reciprocal movement of the plungers, and a plunger stroke limit mechanism for limiting the outward stroke of the plungers and thereby regulate the quantity of fuel injected during each inward pumping stroke thereof, a timing advance connector connected to the cam ring for changing the radial position of the lobes in the plane of revolution of the rollers relative to the rollers to thereby advance or retard the fuel injection depending upon the position of the cam ring, a timing means controlling the movement of a hydraulic timing piston mounted in a cylinder which moves the connector, the improvement which comprises providing an aluminum sleeve with an inside wall providing the cylinder for the timing piston mounted in the housing, so that the sleeve has a hard anodized coating on the wall adjacent the position of the timing piston and with an outside wall to be secured to the housing; boring an enlarged hole in the housing adjacent the timing piston which corresponds to the outside wall of the sleeve; and securing an outside wall of the sleeve in the bore.

SPECIFIC DESCRIPTION

Rotary Fuel Pump

The following description of the pump is from U.S. Pat. No. 4,432,327 and provides the setting for the sleeve (100) of the present invention.

Figure 3:
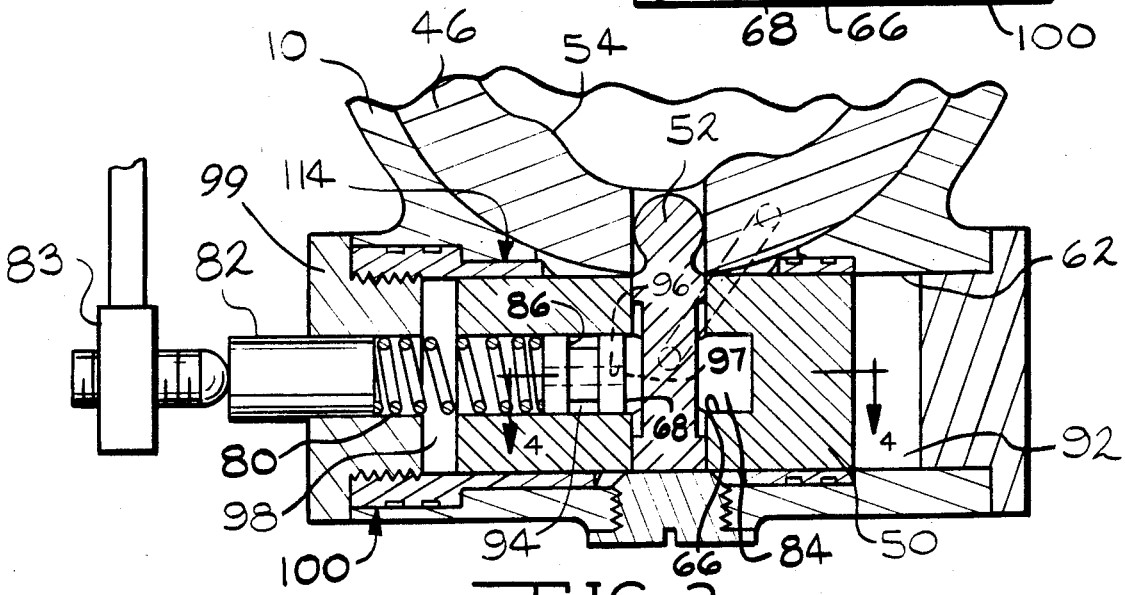
FIG. 3 is a front partial cross-section view of the sleeve (100) of FIGS. 1 and 2 as the timing piston (50) cylinder (62) of a rotary fuel injection pump (10).
Figure 5:
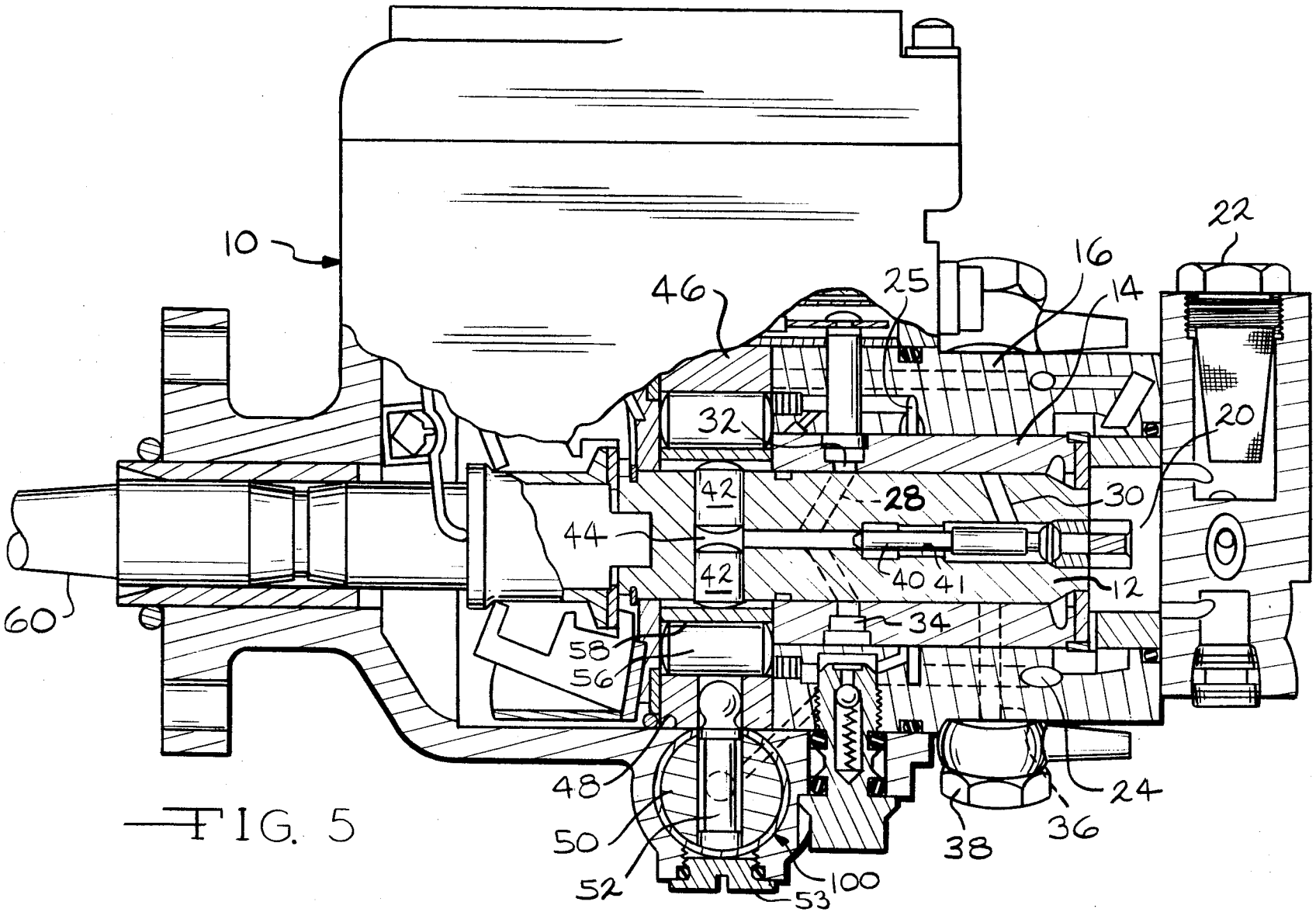
FIG. 5 is an end partial cross-section view of the complete fuel injection pump showing the position of the sleeve (100).

With reference to FIG. 3, a rotary fuel injection pump of the type commercially used for supplying discrete measured charges of liquid fuel to an associated compression-ignition engine is disclosed. The pump includes a housing 10 and a distributor rotor 12 journaled in a bore of a fuel distributor sleeve 14 which is sealed within a bore of a hydraulic distributor head 16 mounted within the pump housing 10.

Mounted at one end of the rotor 12 for rotation therewith is a low pressure vane type transfer pump 20 having an inlet 22 to which fuel is supplied from a supply tank (not shown). The outlet of the transfer pump 20 is connected to an annulus 25 in the hydraulic distributor head 16 by a passage 24.

The rotor 12 is shown as having a pair of fuel inlet passages 28 and a fuel discharge passage 30. As the rotor 12 turns, the inlet passages 28 of the rotor 12 register sequentially with a plurality of radial ports 32 (only two of which are shown) uniformly spaced around the distributor sleeve 14 in a plane of rotation of the inlet passages 28 to provide periodic communication between the annulus 34 and an inlet passage 28 for supplying fuel to the rotor 12. The discharge passage 30 similarly communicates sequentially with a plurality of passage 36 (only one of which is shown). Passages 36 are uniformly spaced around the distributor sleeve 14 in the plane of rotation for the discharge passage 30 as the rotor 12 turns to sequentially deliver pressurized fuel charges from the rotor to a plurality of fuel connectors 36 for delivery of the fuel charges to the cylinders of an associated engine (not shown). A delivery valve 40 located in an axial passage 41 in the rotor 12 controls the backflow of pressurized fuel from the discharge passage 30.

The rotor 12 has an enlarged generally cylindrical portion with a diametral bore which mounts a pair of diametrically opposed plungers 42 for reciprocation therein. The space between the inner ends of the plungers 42 forms a high pressure pump chamber 44 connected to the inlet passages 28 and the discharge passage 30 by the axial passage 41 to alternately receive and discharge fuel as the rotor 12 turns.

Surrounding the plungers 42 in their plane of revolution and around the longitudinal axis of the rotor 12 is a generally circular cam ring 46. The cam ring 46 is mounted in a bore 48 of the housing 10 for limited angular movement and its angular position is controlled by a timing piston 50 operatively connected thereto by a connector 52.

The cam ring 46 has an inner annular cam surface with a plurality of inwardly projecting cam lobes 54 which are positioned to simultaneously actuate the diametrically opposed plungers 42 inwardly. For that purpose, a roller assembly comprising a roller 56 and a roller shoe 58 is disposed between each plunger 42 and the cam ring 46 so that the rollers 56 act as cam followers for translating the cam contour into reciprocal movement of the opposed plungers 42.

In operation, as the rotor 12 is driven by the engine through drive shaft 60, low pressure fuel from the transfer pump 20 is delivered through a port 32 to a rotor inlet passage 28 to the pump chamber 44, it being understood that opposed rollers 56 are angularly disposed with respect to the cam lobes 54 of the cam ring 46 to permit the plungers 42 to move radially outwardly in synchronism with registry of an inlet passage 28 with each port 32 so that fuel can enter chamber 44. As the rotor 12 continues to turn, the inlet passage 28 moves out of registry with the port 32 and the plunger actuating rollers 56 roll up leading surfaces of a pair of cam lobe 54 to power the plungers 42 inwardly and pressurize a charge of fuel in the pump chamber 44 to a high pressure. At this time the discharge passage 30 has moved into registry with a delivery passage 36 connected to one of the cylinders of the engine for injection of a charge of fuel thereof under high pressure. Continued rotation of the rotor 12 repeats the process for sequential delivery of a charge of fuel to each cylinder of an associate engine in timed relation therewith.

Timing Control

Figure 4:
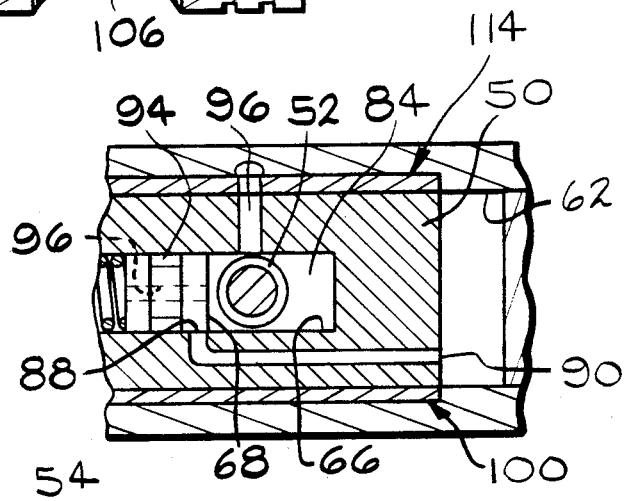
FIG. 4 is an end cross-sectional view of the timing piston (50) and cylinder (62) portion of the fuel injection pump (10) along line 4—4 of FIG. 3 showing the sleeve (100).

With reference to FIG. 4, cam ring 46 is mounted so that it can be angularly adjusted to control the timing of the pumping strokes of plunger 42. The pumping strokes can be adjusted to occur slightly sooner (advanced) or slightly later (retarded) as the drive shaft 60 is rotated. Connector 52 provides means for rotatably shifting the cam ring 46 to adjust the timing.

Connector 52 is driven by a timing piston 50 which is received in a cylinder 62 of the housing 10. Cylinder 62 extends tangentially to and in substantially the same plane as cam ring 46. Piston 50 connects with connector 52 so that the upper portion of connector 52, which interacts with cam ring 46, is movable longitudinally with respect to cylinder 62. It is the piston 50 which causes the wear on the walls of the cylinder 62.

Figure 2:
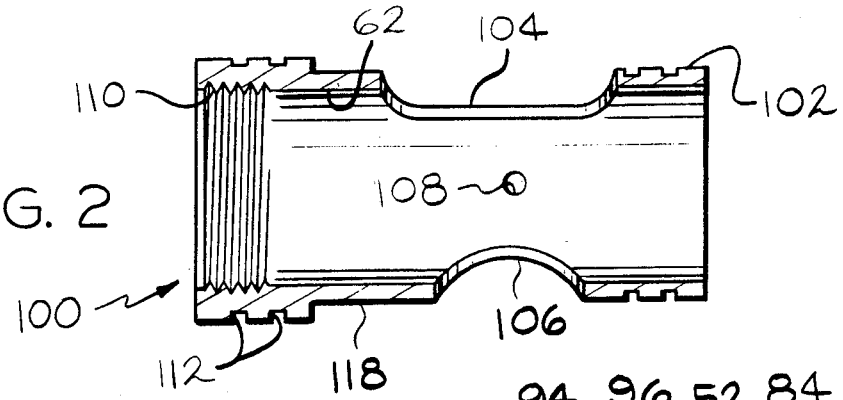
FIG. 2 is a plan view of the sleeve (100) of the present invention.

Piston 50 further provides an axial bore 66 in which a servo valve 68 is slidably received. A servo biasing spring 80 engages one end of servo valve 68 to bias the servo valve 68 to the right as illustrated in FIG. 2. The opposite end of spring 80 engages a spring seat 82 which is received in the left end of cylinder 62.

The longitudinal position of spring seat 82 relative to cylinder 62 may be varied to produce an increase or decrease in the bias exerted by spring 80 on servo valve 68. In a preferred embodiment, spring seat 82 is longitudinally moved in response to a lever arm 83 which is mechanically actuated by an increase in engine load such as the timing control for fuel injection pump disclosed in U.S. Pat. No. 4,224,916.

In operation, regulated transfer pump output pressure is continuously present in valve chamber 84 defined in piston bore 66 by the end of servo valve 68. The pressure in valve chamber 84 exerts a force on servo valve 68 in opposition to the biasing force of servo spring 80. Because the output pressure of the transfer pump is a function of engine speed, the position of servo valve 68 is dependent on engine speed.

As the engine speed increases, the pressure in valve chamber 84 increases to compress spring 80 so that the lead 86 of the servo valve 68 uncovers port 88 of passage 90 and fuel passes from chamber 84 into chamber 92 as defined between piston 50 and the right end of cylinder 62, as illustrated in FIG. 4. As the quantity of fuel in chamber 92 increases, timing piston 50 is forced to the left as shown in FIG. 4 until lead 86 covers port 88 of passage 90 to terminate the flow of fuel between chambers 84 and 92. The termination of the fuel flow from chamber 84 to 92, determines an equilibrium position of piston 50 which in turn, acting through connector 52, fixes the angular position of cam ring 46 and consequently the timing of injection of fuel into the cylinder of the engine.

Upon the decrease of engine speed, the pressure in chamber 84 decreases, resulting in spring 80 forcing servo valve 68 to the right to provide communication between passage 90 and annulus 94 so that fuel is dumped from chamber 92 through bore 96 which communicates with the interior of the pump housing 10, as will be described below, until an equilibrium position of timing control piston 50 is attained.

The foregoing operational description of timing piston 50 essentially provides a means for adjusting the timing to correspond to engine speed, and with respect to the adjustment of spring seat 82, to adjust timing piston 50 in relation to increase or decrease in engine load. As illustrated in FIG. 4, the injection timing is advanced when timing piston 50 moves to the left. Timing is retarded as piston 50 moves to the right.

Sleeve Repair of Cylinder 62

The necessity for the method of the present invention is because of the incompatibility of a steel piston 50 against a die cast aluminum advance cylinder 62, in the Stanadyne TM (Windsor, Conn.) DB2 and DM fuel injection pump housings as shown in FIGS. 3 and 4.

FIGS. 1 and 2 show the sleeve 100 of the present invention which is made of soft aluminum. The sleeve 10 is machined to include a cylindrical member 102 with a first elongate slot 104 for the passage for the connector 52 and a second round passage 106 for a drain hole for plug 53. A side port 88 is provided for passage 90. Threads 110 are provided for mounting the holder 99 for the spring seat 82. The sleeve 100 includes circumferential grooves 112 which hold a bonding agent (not shown) for holding the sleeve 100 in place in the housing 10.

After sleeve 100 has been machined it is subjected to the following treatments:

(1) *Flex Hone:* This hone is used on the cylinder 62 of the sleeve 100 and deburrs the machined edges.

(2) *Stop off Anodizing:* This anodizing is used to control the area selected for subsequent hard coat anodizing. This procedure is similar to the use of common masking tape to prevent application of a coating. Stop off anodizing is optional.

(3) *Finish Honing:* The sleeve 100 is then honed to size, preferably a 0.002 and 0.004 under the original size of the cylinder prior to repairs for repairs. Before anodizing, dimensional requirements are + and − of 0.0005 on the bore of the sleeve 100, for its entire length. When the sleeve 100 is honed to finish size, 0.0001 roundness, straightness and size is maintained. Depending upon the diameter of the advance pistons 50, the cylinder 62 will ultimately determine the I.D. size of the advance piston 50.

Most used pistons 50 will clean up at 1½ thousandths under original size. Which interprets to 0.7481 in piston size after reclamation. The factory standard size is 0.7496–7, approximately 95% are salvageable. Thus the ability to hold and standardize on two sizes, 0.7485, and for the smaller bore 0.7460, with a piston of 0.7455. The smaller size will reclaim, for the most part, the remainder of all worn pistons 50.

(4) *Hard coat Anodizing:* After the cylinder 62 has been stop off anodized, the cylinder 62 is honed to finish size and hard coat anodized. The specification at this point is a minimum of one thousandths build up on any unmasked surface. Industry generally accepts and agrees the relative hardness of hard coat anodizing is 60 to 70 Rockwell (C scale). The procedure is generally described in Kirk-Othmer (Third Edition) 15 pages 309 and 310 (1981). The preferred process used is referred to in the industry as Anolube TM by International Hardcoat of Detroit, Mich.

(5) *Sleeve Mounting:* The sleeve 100 is then ready for insertion into a preprepared bore 114 in the housing 10. The outside surface 118 is coated with a thin layer of a liquid bonding agent, preferably an epoxy resin such that the grooves 112 are filled. The sleeve 100 is then inserted in the bore 114 and cured in place.

(6) *Finish Housing:* The sleeve 100 is then ready for finish honing in the housing 10. The finish honing process will take out no more than 0.001 ths, preferably no more than 0.005–0.0007 ths. The honing process requirements are 8 to 6 RMS on the cylinder 62. The pump 10 is then assembled.

It is unexpected that a thin walled aluminum sleeve 100 with a thin hard anodized cylinder 62 could provide a satisfactory repair for use with steel pistons 50 which has a long life. The sleeve 100 has a wall thickness of between about 0.001 and 0.002 inch. Because of the hardness of anodizing in the sleeve 100 a larger clearance between the piston 50 and the sleeve 100 is possible (i.e. 0.0008 inch vs. 50.0005 inch). It is believed that the diesel fuel provides a sufficient amount of lubrication between the piston 50 and cylinder 62 to allow the repair to be effective.

We claim:

1. In a rotary fuel injection pump for an internal combustion engine including a housing with inlet and outlet passages, a rotor having a longitudinal axis journaled in the housing having a rotor body with a plurality of angularly spaced radially extending bores and a fuel passage in communication with the inner ends of the bores having inlet and outlet ports which communicate alternately with said inlet and outlet passages during rotation of the rotor for alternately conducting fuel to and from the bores respectively, a plunger assembly for each bore comprising a pump plunger reciprocally mounted in the bore to sequentially receive charges of fuel from and deliver them to said inlet and outlet passages respectively, and a plunger operating roller and roller shoe at the outer end of the plunger having a radial position relative to the axis of the rotor, a cam ring with an inner cam contour surrounding the rotor in the plane of revolution of the rollers and engageable therewith to translate the cam contour into reciprocal movement of the plungers, and a plunger stroke limit mechanism for limiting the outward stroke of the plungers and thereby regulate the quantity of fuel injected during each inward pumping stroke thereof, a timing advance connector connected to the cam ring for changing the radial position of the lobes in the plane of revolution of the rollers relative to the rollers to thereby advance or retard the fuel injection depending upon the position of the cam ring, a timing means controlling the movement of a hydraulic timing piston mounted in a cylinder which moves the connector, the improvement which comprises, an aluminum sleeve with an inside wall providing the cylinder for the timing piston mounted in the housing, wherein the sleeve has a hard anodized coating on the wall adjacent the timing piston and wherein an outside wall of the sleeve is secured to the housing.

2. The fuel pump of claim 1 wherein the sleeve is thin walled with a thickness of between about 0.001 and 0.002 inch adjacent the piston.

3. The sleeve of claim 1 which is enlarged and threaded at one end adjacent the timing means.

4. The sleeve of claim 1 wherein the outside wall is bonded to a fitted bore in the housing with a bonding agent.

5. A method of manufacturing a rotary fuel injection pump including a rotary fuel injection pump for an internal combustion engine having a housing with inlet and outlet passages, a rotor having a longitudinal axis journaled in the housing having a rotor body with a plurality of angularly spaced radially extending bores and a fuel passage in communication with the inner ends of the bores having inlet and outlet ports which communicate alternately with said inlet and outlet passages during rotation of the rotor for alternately conducting fuel to and from the bores respectively, a plunger assembly for each bore comprising a pump plunger reciprocally mounted in the bore to sequentially receive charges of fuel from and deliver them to said inlet and outlet passages respectively, and a plunger operating roller and roller shoe at the outer end of the plunger having a radial position relative to the axis of the rotor, a cam ring with an inner cam contour surrounding the rotor in the plane of revolution of the rollers and engageable therewith to translate the cam contour into reciprocal movement of the plungers, and a plunger stroke limit mechanism for limiting the outward stroke of the plungers and thereby regulate the quantity of fuel injected during each inward pumping stroke thereof, a timing advance connector connected to the cam ring for changing the radial position of the lobes in the plane of revolution of the rollers relative to the rollers to thereby advance or retard the fuel injection depending upon the position of the cam ring, a timing means controlling the movement of a hydraulic timing piston mounted in a cylinder which moves the connector, the improvement which comprises:

(a) providing an aluminum sleeve with an inside wall providing the cylinder for the timing piston mounted in the housing, so that the sleeve has a hard anodized coating on the wall adjacent the position of the timing piston and with an outside wall to be secured to the housing;

(b) boring an enlarged hole in the housing adjacent the timing piston which corresponds to the outside wall of the sleeve;

(c) securing an outside wall of the sleeve in the bore; and (d) honing the hard anodized coating.

6. The method of claim 5 wherein the sleeve is thin walled with a thickness of between about 0.001 to 0.002 inch adjacent the piston.

7. The method of claim 5 which is enlarged and threaded at one end adjacent the timing means.

8. The method of claim 5 wherein the outside surface of the sleeve has multiple concentric grooves which are filled with a bonding agent to secure the sleeve to the bore.

* * * * *